United States Patent [19]

Rodskier

[11] Patent Number: 5,048,291

[45] Date of Patent: Sep. 17, 1991

[54] EXHAUST MUFFLER FOR MARINE ENGINES WITH TWO ROWS OF CYLINDERS

[75] Inventor: Christian Rodskier, Torslanda, Sweden

[73] Assignee: AB Volvo Penta, Gothenburg, Sweden

[21] Appl. No.: 443,377

[22] Filed: Nov. 30, 1989

[30] Foreign Application Priority Data

Dec. 16, 1988 [SE] Sweden ..... 8804555

[51] Int. Cl.[5] ..... F01N 7/10; B63H 21/32

[52] U.S. Cl. ..... 60/323; 440/89

[58] Field of Search ..... 440/89; 60/323

[56] References Cited

U.S. PATENT DOCUMENTS

| | | | |
|---|---|---|---|
| 1,816,371 | 7/1931 | Hefti | 440/89 |
| 2,322,522 | 6/1943 | Johan | 440/89 |
| 2,940,249 | 6/1960 | Gospodar . | |
| 4,504,238 | 3/1985 | Neisen | 440/89 |
| 4,713,029 | 12/1987 | Ford . | |
| 4,773,215 | 9/1988 | Winberg | 60/324 |

FOREIGN PATENT DOCUMENTS

| | | | |
|---|---|---|---|
| 0280422 | 8/1988 | European Pat. Off. . | |
| 1922978 | 11/1970 | Fed. Rep. of Germany | 440/89 |

*Primary Examiner*—Douglas Hart

*Attorney, Agent, or Firm*—Young & Thompson

[57] ABSTRACT

An exhaust muffler for marine engines with two rows of cylinders, especially V-engines. The exhaust muffler comprises a horizontal cylindrical container (20) mounted transverse to the rows of cylinders and having an exhaust inlet (26) and an exhaust outlet (27) for each row of cylinders. The container is mounted between the rear of the engine (1) and the boat transom (3).

9 Claims, 2 Drawing Sheets

EXHAUST MUFFLER FOR MARINE ENGINES WITH TWO ROWS OF CYLINDERS

The present invention relates to an exhaust muffler for marine engines with two rows of cylinders, comprising means for collecting exhaust from each row of cylinders with one exhaust inlet and one exhaust outlet for each row of cylinders. The invention also relates to a muffler installation in a boat with at least one engine with two rows of cylinders.

Known exhaust mufflers for marine engines with two rows of cylinders, primarily V-engines, have individual muffler containers for each row of cylinders. These usually cylindrical containers are mounted upright to one side of each cylinder row, i.e. on either side of the engine, which creates problems with space and limits access for service and repair work. This is particularly true with twin engine power plants. This type of muffler installation generally requires the installation of relatively long exhaust pipes with a number of bends.

The purpose of the present invention is to achieve an exhaust muffler for marine engines with two rows of cylinders, which requires less space than the above described known type and which can also be installed with the shortest possible tubing within a space which is often not used for other purposes.

This is achieved according to the invention in an exhaust muffler of the type described above by way of introduction which is characterized in that said means is formed by an elongated container common to both rows of cylinders, said container being mounted with its longitudinal axis horizontal and transverse to the rows of cylinders of the engine, and in that an inlet and an outlet for exhaust from each row of cylinders are disposed at or near each end of the container.

Quite surprisingly such a muffler container, dimensioned with a total volume less than the sum of the volumes of the known muffler containers, has proved capable of providing better muffling of noise than the known installations without requiring any measures to increase the counter pressure in the system. The container can be small enough so that there is room for it in a space which is normally free above the fly-wheel cover between the engine block and the transom. Such a placement also has the advantage that the exhaust conduits from the engine exhaust manifolds to the container and from the container to the boat transom can be made very short and in certain cases without any bends.

Figure 1:
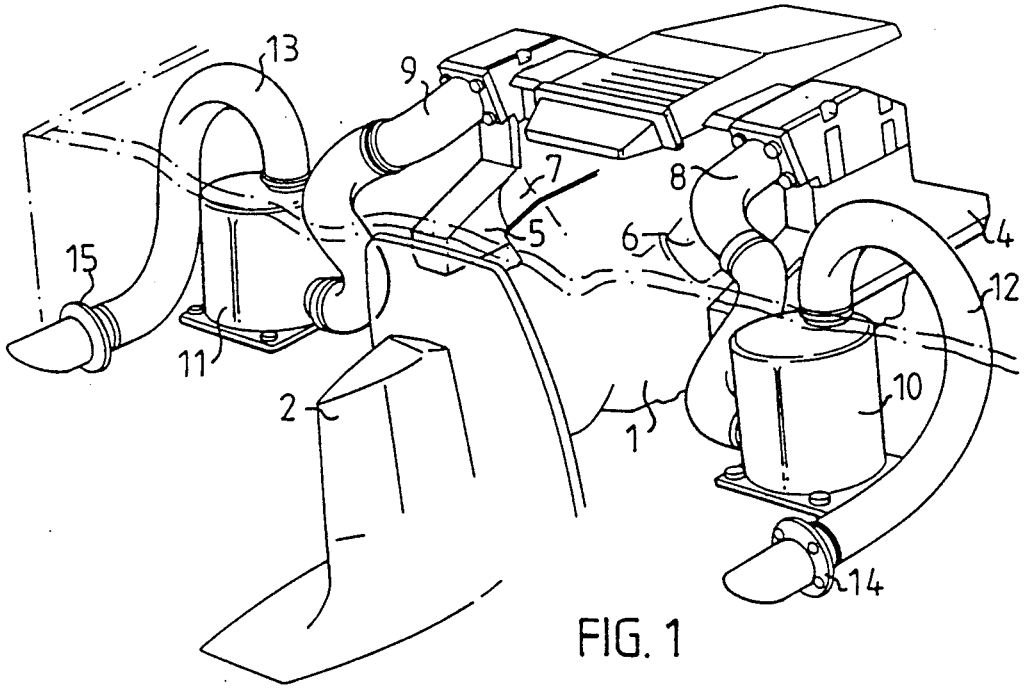
Figure 2:
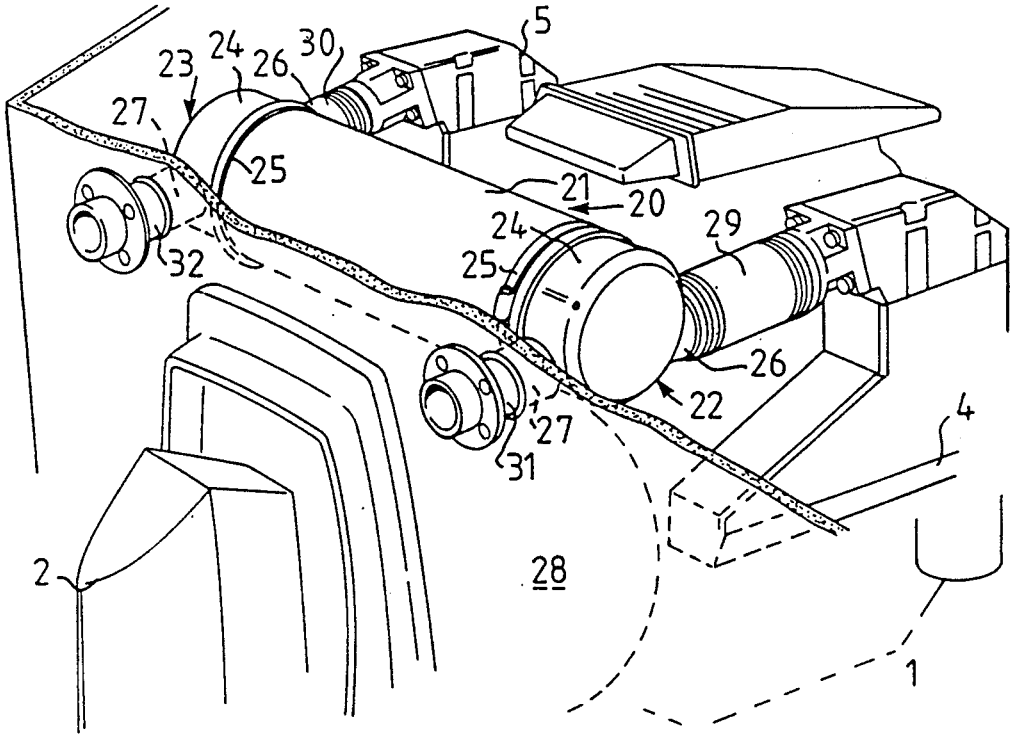
Figure 3:
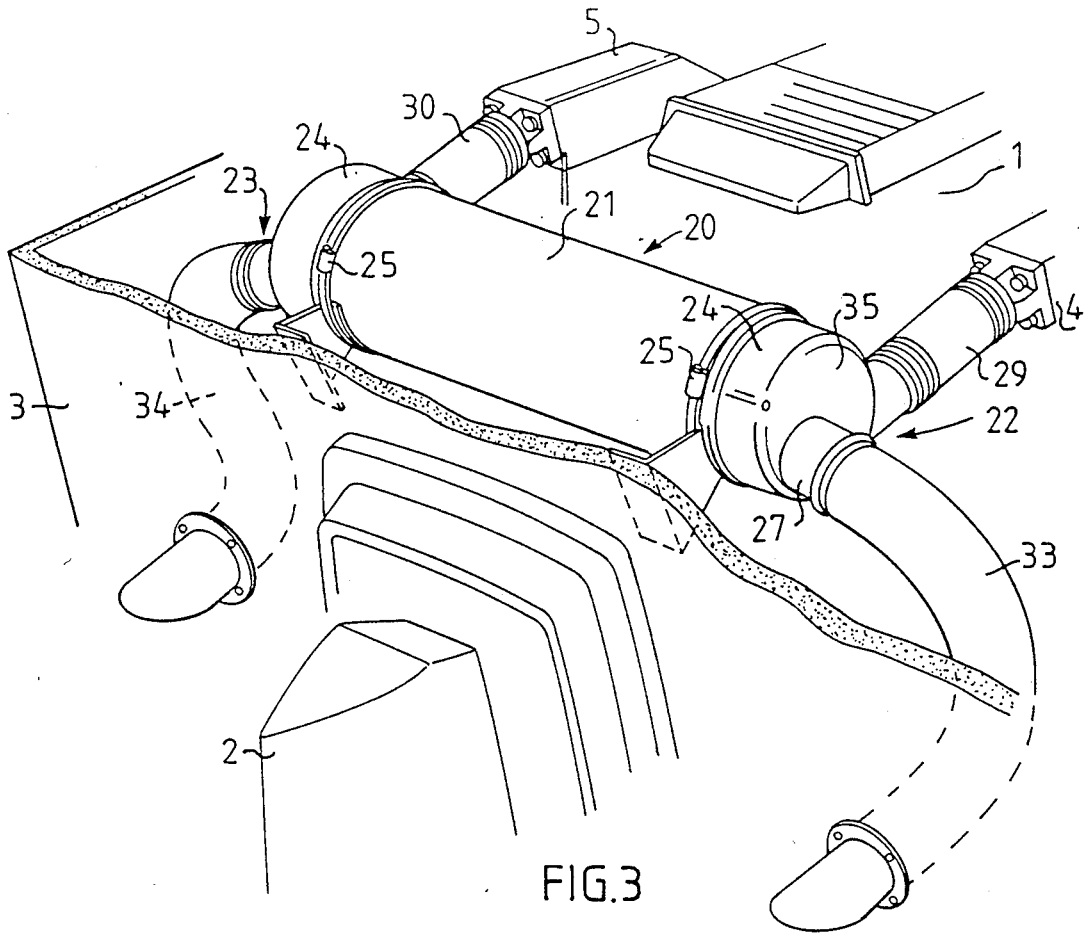
Figure 4:
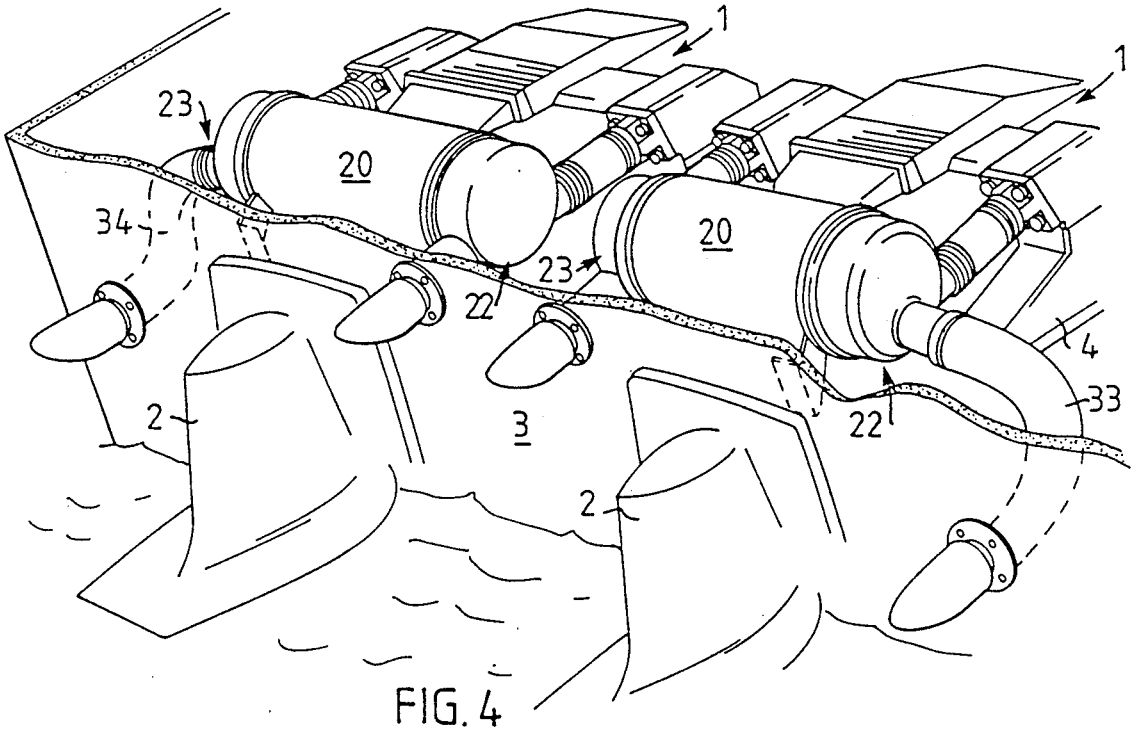

The invention will be described in more detail below with reference to the accompanying drawings, in which FIG. 1 shows a schematic perspective view of a previously known exhaust muffler installation, FIG. 2 shows a schematic perspective view of a first embodiment of a muffler according to the invention, FIG. 3 is a view corresponding to FIG. 2 of a second embodiment and FIG. 4 shows a twin engine Power plant with two exhaust mufflers in a third embodiment.

In FIG. 1, 1 designates a V-engine, for example a V-8, which is coupled to an outboard drive 2, e.g. an Aquamatic drive ®, outside a boat transom 3. Exhaust tubes or pipes 8, 9 lead exhaust and cooling water to upright cylindrical muffler containers 10, 11 containing sound-muffling means with so called "aqualift" from exhaust manifolds 4, 5 on each row of cylinders 6, 7. The tubes 8, 9 extend horizontally into the lower portion of each container 10, 11. The exhaust tubes 12, 13 extend first vertically upwards from the upper end of each container and are then bent to extend horizontally onto pipe stubs 14, 15 which extend beyond the transom of the boat. The installation shown in FIG. 1 requires, as is evident from the figure, a relatively large space on either side of the engine and long exhaust tubes. The installation as a whole is therefore quite space consuming.

FIG. 2 shows a first embodiment of an exhaust muffler according to the invention for a V-engine. The two containers in the known design shown in FIG. 1 have been replaced here with a single container 20 common to both rows of cylinders of the engine 1. This common container 20 is cylindrical and consists of a tubular intermediate portion 21 and two end pieces 22, 23. The intermediate portion is suitably made of elastic material, e.g. reinforced rubber, and the end pieces of metal. The end pieces 22, 23 have cylindrical portions 24, the outer diameter of which is equal to the inner diameter of the intermediate portion 21, so that the latter can be forced over the end pieces and secured thereto with hose clamps 25.

This construction makes it possible to simply adapt the length of the container to the distance between the exhaust manifold outlets. In principle it is possible to keep in stock only one type adapted to the largest engine type. This can be used for smaller engines by cutting the intermediate portion to a suitable length when installing it. The intermediate portion 21 is thus entirely empty, while the end pieces 22, 23 contain flow-diverting baffles (not shown) between an inlet 26 and an outlet 27 which, in the embodiment shown in FIG. 2, are in line with each other. In most marine exhaust systems, the cooling water is also conducted through the muffler and the end pieces 22, 23. Such systems can also contain flaps, valves or sluices to prevent cooling water from flowing in the wrong direction.

As is evident from a comparison of the installations in FIGS. 1 and 2, the latter does not require any space beside the engine. The entire exhaust muffler container can be placed between the transom 3 and the engine block above the fly-wheel casing indicated at 28. The exhaust tubes 29, 30 from the engine to the container 20 and the tubes 31, 32 from the container to the exhaust pipes in the transom can be made straight and short as shown in FIG. 2.

FIG. 3 shows an embodiment of an exhaust muffler installation according to the invention which differs from that described above only in that the exhaust tubes 33 from the container 20 to the exhaust pipes in the transom 3 extend from the end walls 35 in the end pieces.

FIG. 4 shows a twin engine power plant with two exhaust muffler installations, which combine the embodiments shown in FIGS. 2 and 3. The engines are here provided with individual muffler containers 20, which at their ends facing each other have end pieces 22, 23 of the type shown in FIG. 2, i.e. with inlet and outlet in a line with each other. The ends of the containers 20 facing away from each other have end pieces of the type shown in FIG. 3, i.e. with an exhaust outlet 33, 34 in the end wall 35 of the respective end piece. As is evident from the Figures, the arrangement according to the invention provides great flexibility with the possibility of exceptionally compact installation, particularly for twin engine power plants.

What is claimed:

1. Exhaust muffler installation in a boat with at least one engine with two rows of cylinders and a propeller drive coupled to the engine and mounted on the outside of the boat transom, comprising means for collecting exhaust from each said row of cylinders with one exhaust inlet and one exhaust outlet for each row of cylinders, characterized in that said means is formed by an elongated container (20), said container being mounted with its longitudinal axis horizontal and transverse to the rows of cylinders of the engine (1) between the rear of the engine and the boat transom (3), and in that an inlet (26) and an outlet (27) for exhaust from each row of cylinders are disposed at or near each end of the container.

2. Exhaust muffler according to claim 1, characterized in that the container (20) consists of an elongated container portion (21) open at both ends and a pair of end pieces (22, 23) removably secured to either end of the elongated container portion, each end piece having an inlet (26) and an outlet (27) for exhaust and when necessary for cooling water.

3. Exhaust muffler according to claim 1, characterized in that the container (20) is cylindrical and that its length substantially exceeds its diameter.

4. Exhaust muffler according to claim 2, characterized in that the elongated container portion (21) consists of elastic material and that the end pieces (22, 23) are of rigid material.

5. Exhaust muffler according to claim 2, characterized in that each end piece (22, 23) has a cylindrical portion (24) which is open towards the elongated container portion (21) and forms an extension thereof.

6. Exhaust muffler according to claim 5, characterized in that the inlet (26) and the outlet (27) are arranged at least essentially in a line with each other in the cylindrical portion (24) of the end piece (22, 23).

7. Exhaust muffler according to claim 5, characterized in that the inlet (26) is arranged in the cylindrical portion (24) of the end piece (22, 23) and that the outlet (27) is arranged in an essentially flat end wall (35) of the end piece.

8. Exhaust muffler according to claim 2, characterized in that the end pieces (22, 23) contain flow-diverting wall elements between the inlet (26) and the outlet (27).

9. Exhaust muffler installation according to claim 1, characterized in that the container (20) is cylindrical and is placed above the engine fly-wheel casing (28).

* * * * *